United States Patent [19]

Merli

[11] 4,355,264

[45] Oct. 19, 1982

[54] STARTER CIRCUIT FOR DISCHARGE LAMP

[75] Inventor: Gian F. Merli, Saint Gratien, France

[73] Assignee: Claude, S.A., Boulogne-Billancourt, France

[21] Appl. No.: 232,609

[22] Filed: Feb. 9, 1981

[30] Foreign Application Priority Data

Oct. 30, 1980 [FR] France ..... 80 23210

[51] Int. Cl.[3] ..... H05B 41/16

[52] U.S. Cl. ..... 315/289; 315/207; 315/240; 315/243

[58] Field of Search ..... 315/101, 205, 207, 209 R, 315/239, 243, 289, 290, DIG. 2, 240

[56] References Cited

U.S. PATENT DOCUMENTS 3,679,936 7/1972 Moerkens ..... 315/289 X 4,210,850 7/1980 Britton ..... 315/290

FOREIGN PATENT DOCUMENTS 2280289 2/1976 France ..... 315/289

*Primary Examiner*—Eugene R. La Roche

*Attorney, Agent, or Firm*—Edward J. Coleman

[57] ABSTRACT

A starter circuit for a high power discharge lamp connected to an AC source via a series inductor. The starter circuit comprises a capacitor connected in series with a triac across the lamp, and a branch including a first resistor connected in series with a zener diode and a second resistor between the junction of the capacitor and triac and one side of the AC source. A driving circuit for the triac includes a diac connected to the junction of the second resistor and zener diode.

1 Claim, 1 Drawing Figure

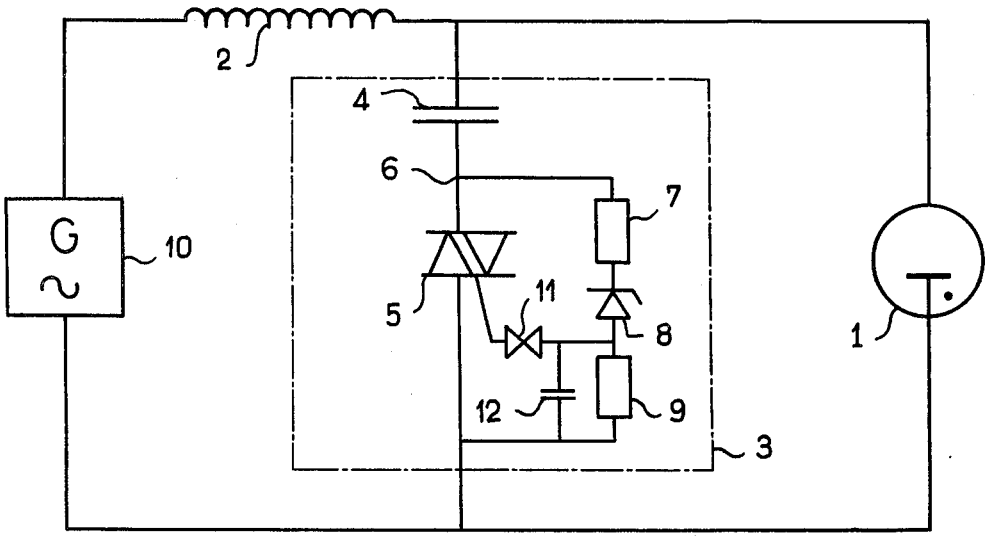
2
4
6
7
G
10
5
11
8
1
12
9
3

STARTER CIRCUIT FOR DISCHARGE LAMP

BACKGROUND OF THE INVENTION

This invention is concerned with starting circuits for high power discharge lamps, and more particularly, with a starter circuit for a high power metal iodide discharge lamp.

Starter circuits for discharge lamps may be differently designed. Since the lamp is generally series connected to an inductor, the latter may be provided with an intermediate output and connected in order to constitute an auto-transformer and, thus, to increase the starting voltage applied to the lamp.

However, it has been found that the corresponding apparatus is undesirably heavy, combersome and expensive, and cannot operate if it is located quite far from the corresponding lamp.

Another kind of starter circuit is, for instance, described in the French Pat. No. 2 280 289. This circuit includes a thyristor the starting angle of which is modified as the line voltage. However, such a circuit generates undesired transient currents before it generates the useful impulse and, thus, wastes energy.

It is known that to start a 2000 Watt discharge lamp, the circuit must generate an impulse having a peak voltage which is at least 1100 Volts and a has duration greater than 100 microseconds, as measured at 900 Volts.

SUMMARY OF THE INVENTION

An object of the present invention is to provide a starter circuit which eliminates the above mentioned disadvantages but having reduced complexity and cost, and enhanced reliability with respect to other known starter circuits.

According to the present invention, the starter circuit, which is connected in parallel with the controlled lamp, comprises a capacitor in series connection with a triac, and a branch including a first resistor in series connection with a zener diode and a second resistor, this branch being connected between the junction point of the capacitor and of the triac, and one side of the AC source. The driving circuit of the triac is connected to the junction point of said second resistor and said zener diode, and includes a diac.

BRIEF DESCRIPTION OF THE DRAWING

The invention will be more fully described hereinafter in conjunction with the accompanying drawing, in which the single FIGURE is a schematic illustration of a starter circuit in accordance with the invention.

DESCRIPTION OF PREFERRED EMBODIMENT

Referring now to the FIGURE, the discharge lamp 1 is series connected via an inductor 2 to the AC source 10 generating a 380 Volt alternating voltage.

The starter circuit 3 is connected in parallel to the discharge lamp 1. It includes a capacitor 4 in series connection with a triac 5. A branch including in series a first resistor 7, a zener diode 8 and a second resistor 9 is connected betweeen the junction point 6 of the capacitor 4 and the triac 5, and one of the outputs of the AC source 10.

The drive circuit of the triac 5 is connected to the junction point of the second resistor 9 and the zener diode 8. It includes a diac 11, and a capacitor 12 shunting the resistor 9.

In operation, assuming that the lamp 1 is initially switched off, when the AC source is connected, the triac 5 becomes a closed switch when the voltage across the diac 11 is higher than the breakdown voltage (32 volts) due to the branch 7, 8, 9 constituting a divider bridge.

A charge is then applied to the capacitor 4 during one of the half cycles of the AC source 10. On the next half cycle, the capacitor 4 is discharged and, due to the inductor 2, a high voltage impulse is applied to the lamp. This impulse is sufficient to ignite the arc tube of the lamp.

Upon starting of the lamp, the voltage across the starter circuit drops and decreases to an insufficient value to breakdown the diac 11, whereupon, the triac 5 becomes an open circuit. As it can be seen, the zener diode 8 allows the control of the starter angle of the triac 5.

Although the invention has been described with respect to a specific embodiment, it will be appreciated that modifications and changes may be made by those skilled in the art without departing from the true spirit and scope of the invention. For example, more than one zener diode may be substituted for the zener diode 8; more particularly three series connected zener diodes may be substituted for the zener diode 8.

I claim:

1. A starter circuit for a high power discharge lamp connected to an AC source via an inductor, the starter circuit comprising, in combination:
   - a capacitor series connected with a triac across said lamp;
   - a branch including a first resistor connected in series with a zener diode and a second resistor between the junction point of said capacitor and triac and one of the outputs of the AC source; and,
   - a driving circuit for said triac including a diac connected between the triac and the junction point of said second resistor and zener diode.

* * * * *